United States Patent [19]

Annas, Sr.

[11] 4,166,556

[45] Sep. 4, 1979

[54] APPARATUS FOR REMOVING FLACCID ARTICLES FROM FORMS AND STACKING THE ARTICLES IN LAID OUT CONDITION

[76] Inventor: Dulin L. Annas, Sr., Rte. 7, Indian Hills, Hickory, N.C. 28601

[21] Appl. No.: 837,227

[22] Filed: Sep. 27, 1977

[51] Int. Cl.[2] ..... A47J 51/06; B65G 57/16

[52] U.S. Cl. ..... 223/112; 223/76

[58] Field of Search ..... 223/75, 76, 77, 112, 223/78, 79, 80, 111; 214/1 R, 1 B, 1 BA, 8

[56] References Cited

U.S. PATENT DOCUMENTS

| | | | |
|---|---|---|---|
| 1,898,918 | 2/1933 | Wanamaker et al. | 223/112 |
| 2,136,902 | 11/1938 | Griffin | 223/112 |
| 3,790,047 | 2/1974 | Laxson | 223/112 |

*Primary Examiner*—Louis Rimrodt

[57] ABSTRACT

Apparatus for automatically boarding, stripping and stacking hosiery. Interiorly heated boarding forms are mounted on a table for indexing from a loading station at which an operator places hosiery on the forms to a stripping station at which the forms are presented in sets, with spaced clamps engaging the hosiery on the forms of the set at the stripping station and removing them longitudinally of the forms. The clamps are mounted on a carrier that moves on a carriage with the carriage moving laterally of the forms to move the clamps into clamping position and the carrier moving in tracks on the carriage to move the clamps vertically for stripping the hosiery longitudinally from the forms and then to a horizontal position at which the clamps dispose the hosiery in laid out disposition above a stacking table for release onto a collection board. The forms are spaced apart a distance equivalent to the width of the hosiery with the hosiery deposited on the stacking table at this spacing. The stacking table is shiftable laterally to receive the hosiery of alternate sets of hosiery in the spaces between the hosiery of the preceding set to form a layer. Periodically the stacking table is rotated 90° to form a stack of crosswise layers, and the table is lowered in increments to maintain the level at which the hosiery sets are received the same throughout building of the stack.

23 Claims, 20 Drawing Figures

APPARATUS FOR REMOVING FLACCID ARTICLES FROM FORMS AND STACKING THE ARTICLES IN LAID OUT CONDITION

BACKGROUND OF THE INVENTION

The present invention relates to apparatus for handling flaccid articles and more particularly to apparatus for removing flaccid articles from forms and stacking them in laid out condition. In the preferred embodiment of the present invention the apparatus is directed to removing hosiery from boarding forms and stacking the hosiery in laid out condition while manipulating the receiving means to form the hosiery in a stack of crosswise layers.

Flaccid articles, such as hosiery, are difficult to handle with automatic equipment where it is desirable to stack the articles in laid out condition and to build a stack of the laid out articles. Examples of prior art apparatus for stripping hosiery from boarding forms and depositing on tables or trays are disclosed in Coulston et al U.S. Pat. No. 1,126,619 and Griffin U.S. Pat. No. 2,136,902, which disclose grippers for the heel and toe of hosiery on horizontally disposed boards, with the grippers or boards movable horizontally to strip the hosiery from the boards and allow the hosiery to drop generally flat onto a receiving table therebelow. Another prior art example is Brewin et al U.S. Pat. No. 3,355,074, which discloses grippers engaging the heel and toe of hosiery on boarding forms with separation of the grippers and forms resulting in the hosiery being engaged by the grippers and hanging therefrom with the grippers moving to draw the hosiery over a deflector plate moving into a tray with the deflector plate serving to restrain the hanging hosiery in somewhat laid out condition as the hosiery is drawn into the tray by the grippers.

With these prior art strippers, the hosiery is uncontrolled and requires either a specific close proximity between the form and receiving table or some type of special element for guiding and positioning the hosiery as the mechanism carriers it in a somewhat uncontrolled disposition to the collection table or tray. In contrast, the present invention provides an apparatus that removes articles from forms in a laid out disposition and maintains the articles in this disposition until it releases them onto receiving means, thereby providing controlled and accurate stacking of articles in an automatic operation.

SUMMARY OF THE INVENTION

Briefly described, the present invention is for an apparatus for removing flaccid articles from forms and stacking the articles in laid out condition. The apparatus includes movable means for engaging articles on forms adjacent opposite ends of the articles, with means for moving the article engaging means from the forms to remove the articles from the forms and position them over receiving means in laid out disposition. Means are provided for operating the article engaging means to engage the articles on the forms adjacent opposite ends of the articles, to maintain the engaging during removing and positioning, and to release the articles onto the receiving means in laid out condition.

Preferably, the article engaging means includes clamp means positionable adjacent opposite ends of an article on the form and engageable therewith and with the moving means moving the clamped article from the form; the moving means also moves the article engaging means laterally of the form to position the clamp means for article engagement at the form. The clamp means includes a clamp member yieldably biased in the direction of the form for yieldable engagement with the article and form upon the aforementioned lateral movement and a clamp member movable against the article and form on the opposite side thereof from the yieldably biased clamp member, with the movable clamp member being openable to accommodate movement past the form upon the aforementioned lateral movement prior to clamping. The means for moving the article engaging means also preferably includes a carriage and a carrier movably carried on the carriage with the clamp means mounted on the carrier for movement longitudinally of the forms with respect to the carriage and to an article laid out position, the carriage being laterally movable to move the carrier and clamp means to the receiving means and to the forms. Preferably means are provided for moving the article receiving means between a plurality of article receiving positions spaced linearly for receipt of articles in adjacent parallel disposition to form a layer of articles on the receiving means, with means rotating the article receiving means between a plurality of article receiving positions to receive articles in crosswise stacked disposition, and with means for incrementally lowering the receiving means to receive subsequent layers of articles at generally the same level as that at which the initial layer is received.

In the preferred embodiment, there are a plurality of forms mounted in sets on a base with the forms in each set being in longitudinally parallel relation and the base being indexable to position the sets of forms sequentially for removal of articles therefrom, with the article engaging means including a plurality of clamp means for simultaneously engaging articles on the forms of a set for removing, positioning and releasing the articles in sets. The forms in each set are disposed generally coplanar and the sets are disposed circumferentially on the base. A plurality of clamp means are provided with a common linkage for simultaneous operation thereof and each clamp means includes a clamp member yieldably biased in the direction of the form and movable thereagainst upon lateral movement for yieldable engagement with the article and form, and a pair of openable clamp members movable against the article and form on the opposite side thereof from the yieldably biased clamp member and against which the yieldably biased clamp member clamps the article upon removal from the form, with the openable clamp members being openable to accommodate movement past the form upon lateral movement prior to clamping.

In the preferred embodiment the carrier is guided on the carriage by a pair of spaced tracks having first components parallel to the longitudinal extent of the forms for guiding movement of the clamp means longitudinally thereof to remove articles from the forms, second components extending from the first components away from said forms for guiding the carrier to move the clamp means to the article laid out position. The carrier has a track follower engaged in each track and means are provided for engaging the carrier at a spacing from the followers for moving the carrier at the engagement therewith reciprocally and parallel with the longitudinal direction of the forms. This latter means includes a pair of spaced endless chains each trained around a pair of spaced sprockets that are driven in a single direction to impart generally reciprocal movement to the carrier at the engagement therewith while the carrier at the followers follows the first and second components and also follows a third component connecting the first and second components.

Further, in the preferred embodiment, the plurality of forms are disposed generally coplanar at lateral spacings generally equivalent to a multiple of the laid out lateral extent of an article and the means for moving the article receiving means moves it laterally between a plurality of article receiving positions corresponding in number to the multiple and at spacings equivalent to the laid out lateral extent of an article for sequential receipt of a plurality of sets of parallel articles to form a layer on the receiving means.

DESCRIPTION OF THE PREFERRED EMBODIMENT

Figure 2:
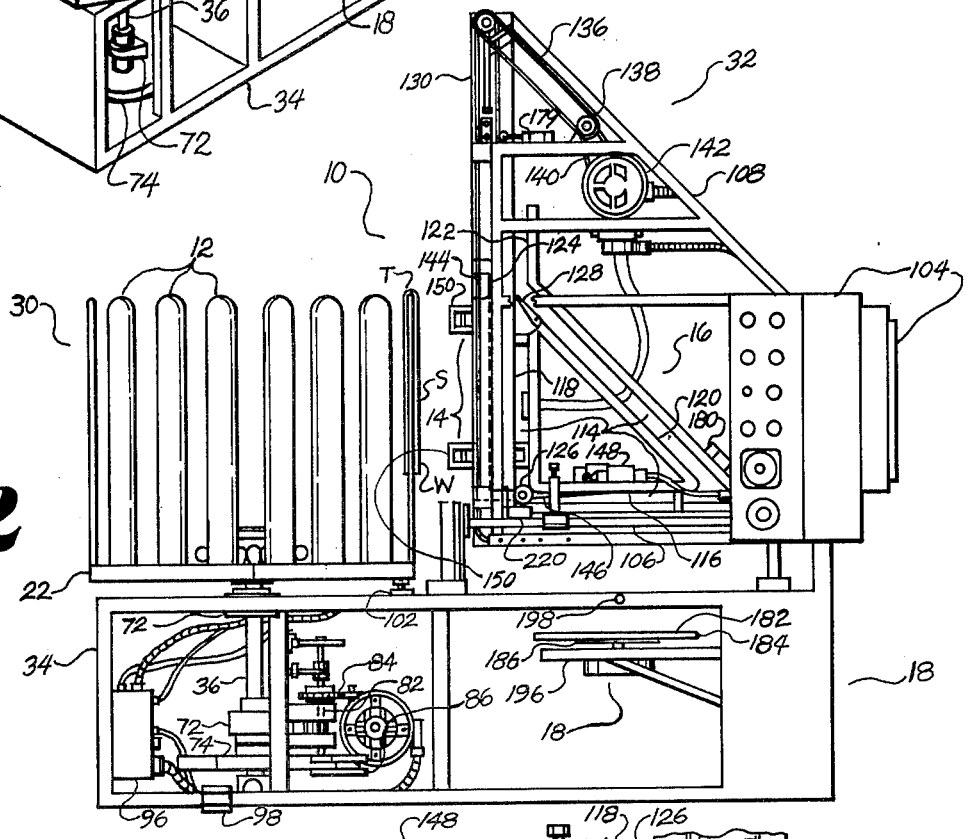
FIG. 2 is a side elevation of the apparatus of FIG. 1.
Figure 3:
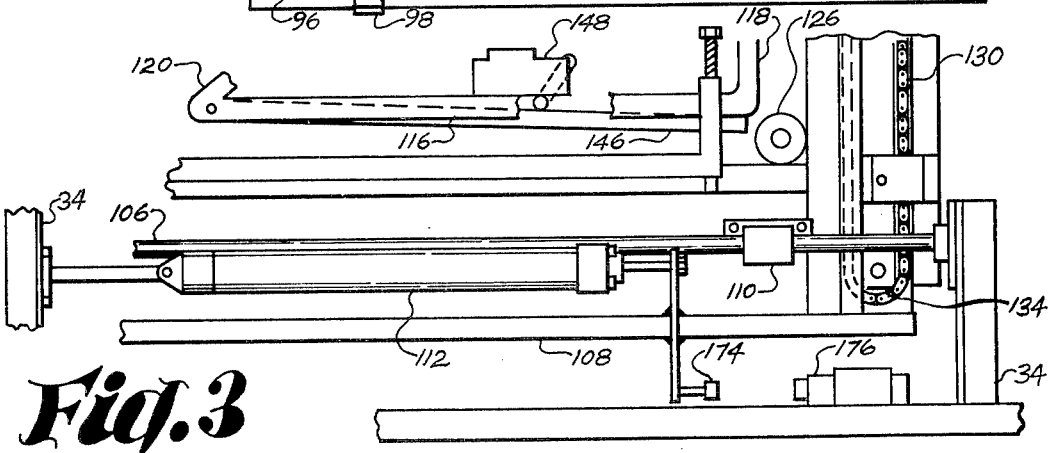
FIG. 3 is an enlargement of a side elevation opposite that of FIG. 2 showing a portion of the carriage and carrier guiding and control mechanisms.

Referring to the accompanying drawings, the apparatus 10 of the preferred embodiment of the present invention is directed to removing or stripping flaccid articles, such as knit hosiery, and particularly stockings, from hosiery boarding forms 12 and stacking the articles in laid out condition. The apparatus 10 includes movable article engaging means 14 that engages stockings on the forms adjacent opposite ends of the stockings, means 16 for moving the article engaging means 14 from the forms 12 to remove the stockings from the forms and position them horizontally over receiving means 18, and operating means 20 for operating the article engaging means to engage stockings on the forms, to maintain the engaging during positioning of the article engaging means over the receiving means 18, and to release the stockings onto the receiving means 18 in laid out condition. In the illustrated embodiment as best shown in FIG. 2, the article engaging means 14 includes clamp means 150 respectively located adjacent opposite ends T and W of a stocking S on the form 12 and the moving means 16 moves the article engaging means 14 laterally to position the clamp means 150 for engagement of a stocking on the form, then longitudinally of the form to slide the clamp means 150 and clamped stocking S from the form, then to a position over the article receiving means 18 for release of stockings clamped by the clamp means. A plurality of forms 12 are mounted in vertically upstanding disposition on a rotatably indexing base or table 22 for presenting forms in sets for engagement by the article engaging means 14 to remove or strip stockings therefrom. These sets of stripped stockings are then carried by the article engaging means 14 to the article receiving means 18, which moves laterally, rotationally and vertically in relation to the release of stockings thereonto to form a stack of layers of stockings with each successive layer having the stockings therein laid crosswise of the stockings in the previous layer, thereby providing a stable stack with an automatic operation.

Figure 1:
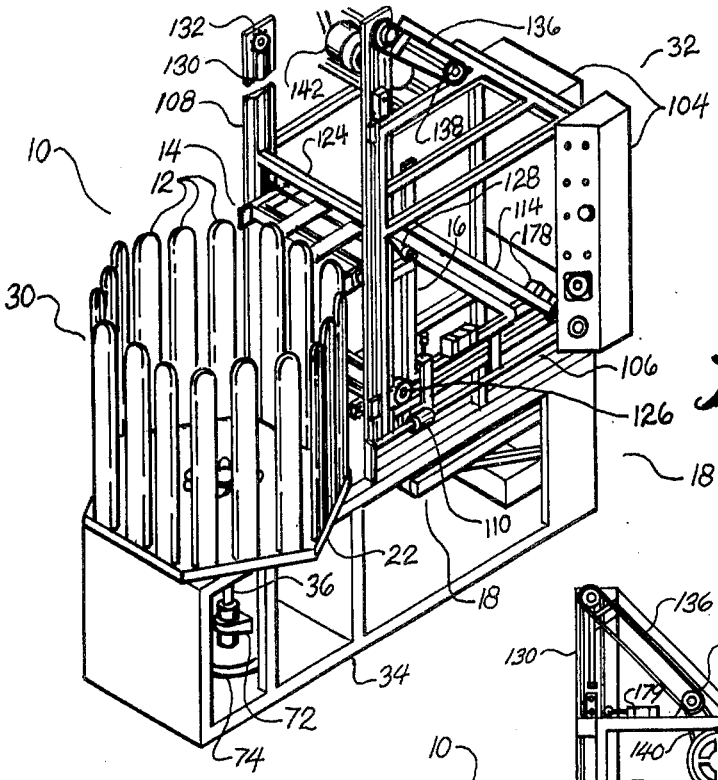
FIG. 1 is a perspective view of a hosiery boarding, removing and stacking apparatus incorporating the preferred embodiment of the present invention.

As illustrated in FIGS. 1 and 2, the apparatus 10 includes a drying section 30 and a removal and stacking section 32. A frame 34 forms the support for the apparatus and has mounted thereon in the drying section 30 a vertical shaft 36 atop which is attached the rotatably indexing base 22 that is hexagonal in shape and has mounted circumferentially along each straight side thereof a set of three boarding forms 12 equally spaced from each other and extending upwardly from the base 22 in longitudinally parallel and generally coplanar relation. The forms 12 are selected length, width and thickness for the particular stockings to be boarded, and are disposed at spacings of about twice their width for reasons to be explained hereinafter. The forms 12 are each efficiently formed from a length of thin aluminum tubing flattened to a suitable oval cross section, pressed flat together at one end and rounded, welded closed, and polished thereat to form the upper end of the form.

The forms 12 are provided with electrical heating elements 42 disposed therein for even heating interiorly, and temperature control is by conventional adjustable thermostat devices 44 provided in the bases of the forms 12 and having sensing bulbs 46 extending therefrom into the heated area. Electrical current is supplied to each form 12 by a pair of wires 48 extending from a pair of rotating slip rings 50 which are carried in a rotating insulating body 52 attached to the indexing base 22 for rotation therewith. Electrical current is supplied to the slip rings 50 by a corresponding pair of stationary slip rings 54 mounted in a stationary insulating body 56 and biased into contact with the slip rings 50 by the pressure springs 58 acting on the pressure studs 60 which are connected to the slip rings 54 through holes in the body 56 and prevent rotation of the rings 54 in the body 56. The body 56 is connected to a flange 62 on a stationary vertical tube 64 mounted from the frame 34, and electrical conductors 66 are brought through the tube 64 for connection to the upper ends of the pressure studs 60 to supply electrical current to the slip rings 54 and thereby to the slip rings 50 and to the boarding forms 40.

Figure 6:
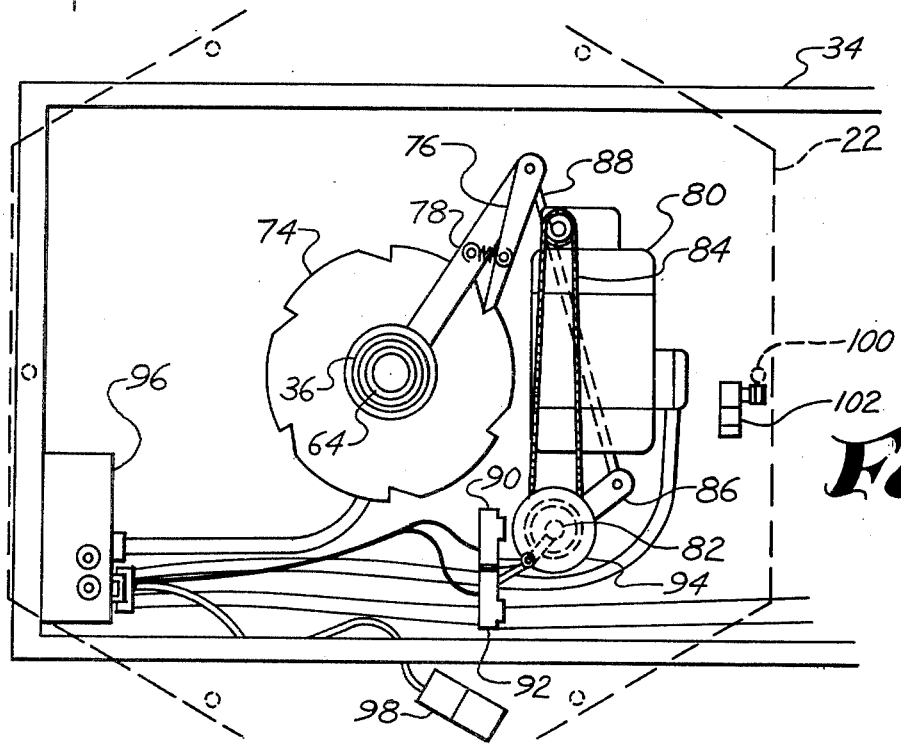
FIG. 6 is a plan view of the operating mechanism for the table of FIG. 5.
Figure 7:
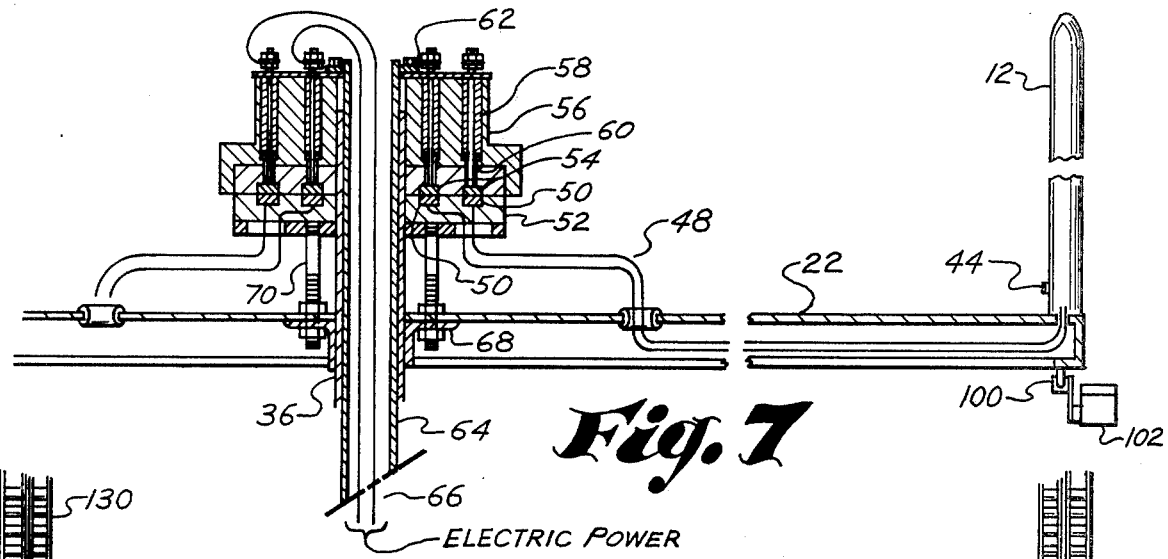
FIG. 7 is an enlarged vertical sectional view of the arrangement for heating the forms of FIG. 5.
Figure 8:
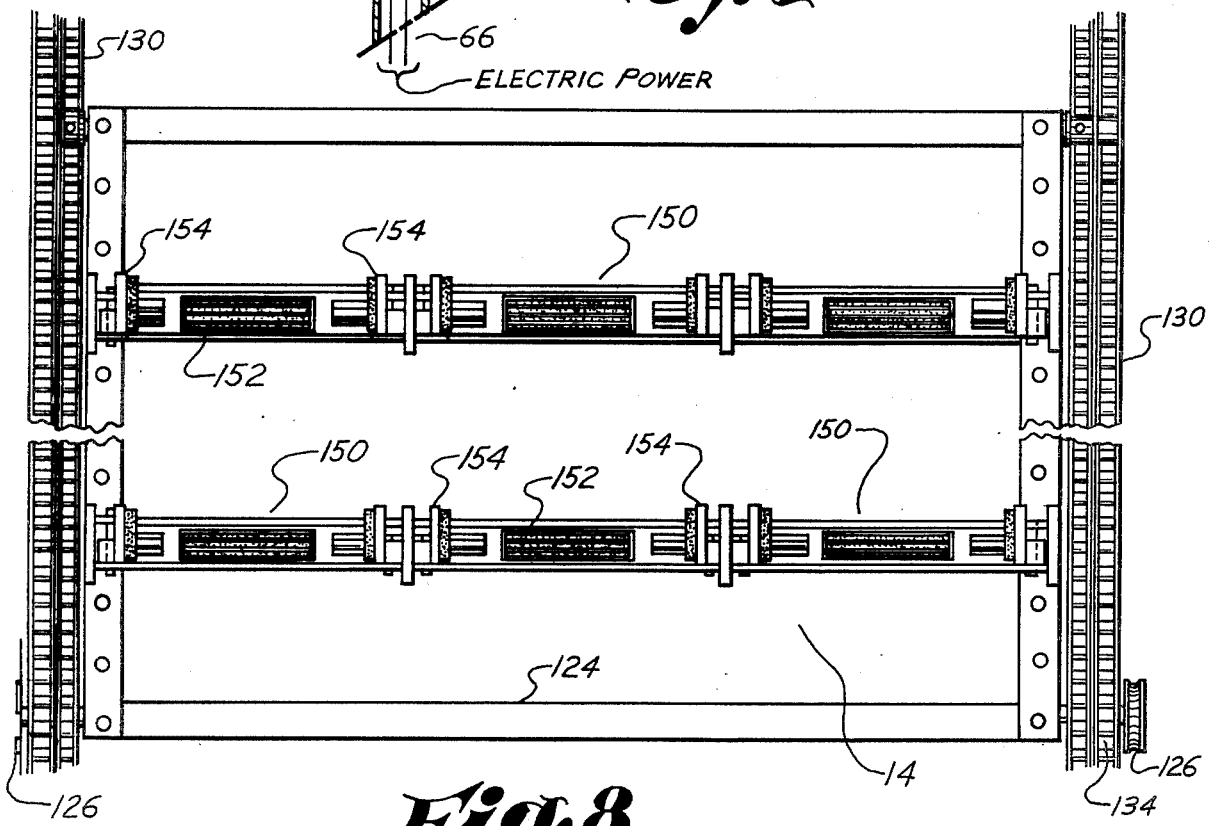
FIG. 8 is a front elevation view of the article engaging means in open position.
Figure 9:
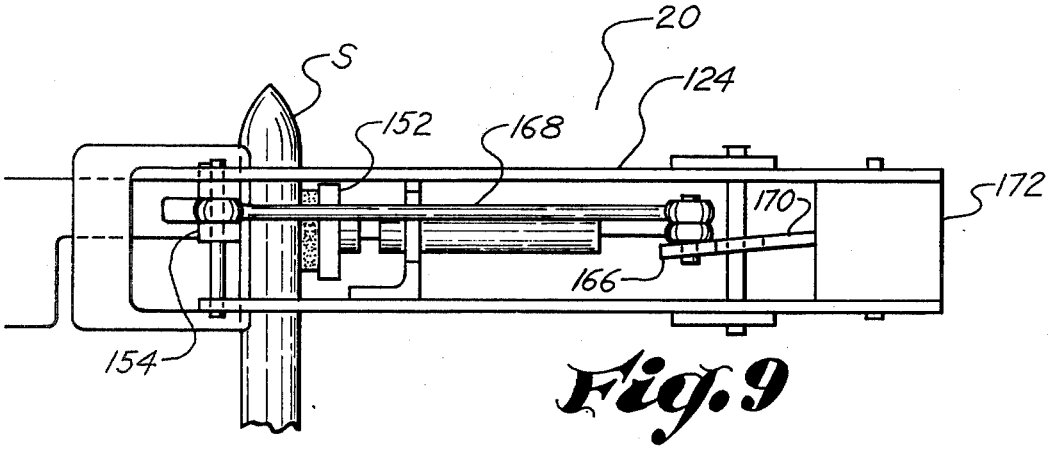
FIG. 9 is an enlarged side elevation of one of the clamp means of FIG. 8.

The vertical shaft 36 has a flanged member 68 attached thereto for driving connection to the rotatably indexing base 22 by the studs 70. The vertical shaft is mounted in bearings 72 mounted on the frame 34 for vertical rotation of the shaft. As shown in FIG. 6, a ratchet 74 is attached to the shaft 36 near the lower end thereof and is indexed by a spring-biased pawl 76 pivoted from a swing arm 78 journaled on the shaft 36 for angular motion thereabout. An electrical gear motor drive 80 drives a crank shaft 82 through a chain drive 84, and a crank arm 86 is mounted on the crank shaft 82 and connected at its outer end to the free end of swing arm 78 by a connecting rod 88, causing the swing arm 78 to oscillate on the shaft 36. The pawl 76 is thereby driven to index the ratchet 74 and in turn the indexing base 22. Limit switches 90 and 92 are mounted from the frame 34, are actuated by a cam 94 mounted on the crank shaft 82, and cooperate with the control panel 96 to stop the gear motor drive 80 upon completion of each index and to allow the restarting of the drive 80 upon actuation of the foot switch 98 connected to the control panel 96, or automatically by a timing switch provided in the panel 96. A pin 100 mounted on the base 80 actuates a third limit switch 102 mounted from the frame 34 as the indexing base 22 completes an index movement and presents three forms 12 to the removal and stacking section 32. Actuation of the limit switch 102, which is connected to the main control panel 104, initiates a stocking removal and stacking cycle for the apparatus 32.

Figure 4:
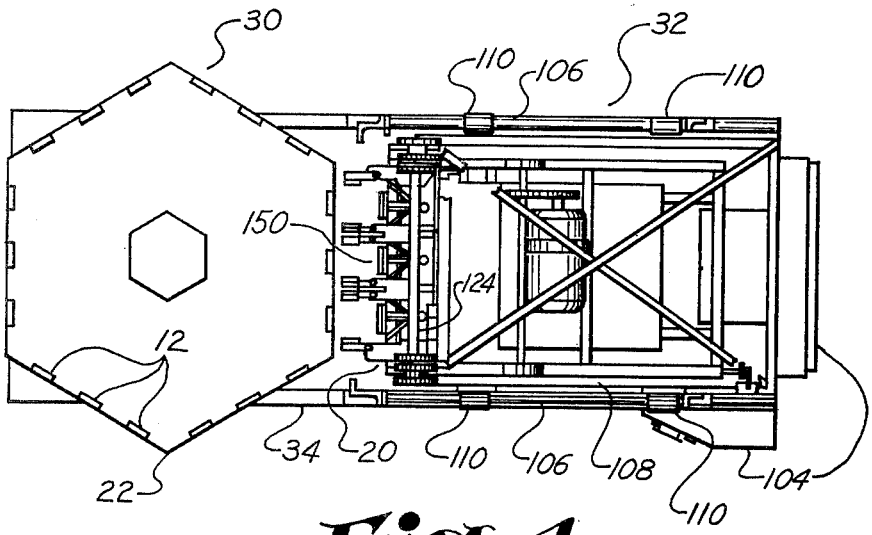
FIG. 4 is a plan view of the apparatus of FIG. 1.
Figure 5:
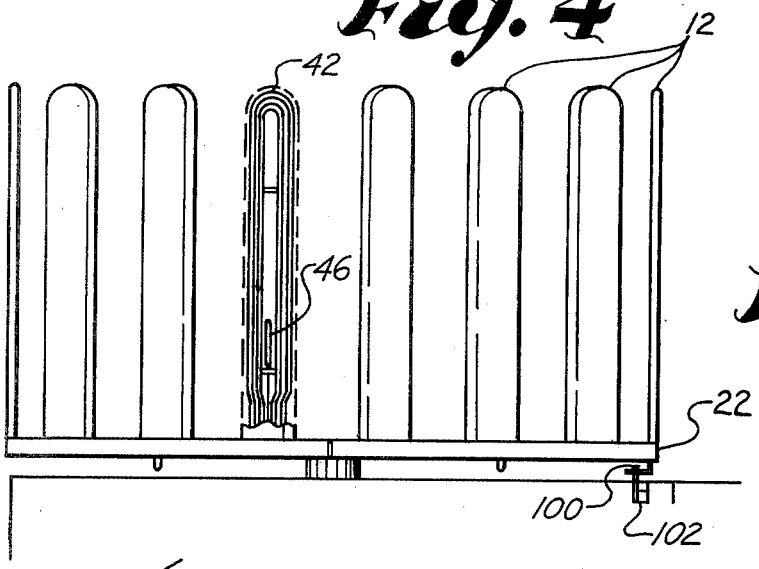
FIG. 5 is an enlargement of the forms and indexing table, showing one of the forms broken away to expose its interior.

The aforementioned means 16 for moving the article engaging means 14 includes a pair of horizontal slide rods 106 mounted at the sides of the frame 34, as shown in FIGS. 1, 2 and 4, for support of a selectively reciprocable carriage 108 by means of slide bearings 110 attached to the carriage 108 and sliding on the rods 106. The carriage 108 is reciprocated for movement laterally of the forms 12 to position the article engaging means 14 carried thereby at the forms for clamping of stockings thereat. This movement is accomplished by a fluid powered cylinder 112 connected between the frame 34 and the carriage 108, which includes a pair of spaced roller tracks 114 having horizontal legs 116 thereof disposed parallel to the slide rods 106, vertical legs 118 connected to the horizontal legs 116 and extending thereabove at the end thereof closest to the drying apparatus 30. Diagonal legs 120 of the tracks 114 are connected to the horizontal legs 116 at the end thereof away from the apparatus 32 and extend upwardly to connect to the vertical legs 118 below the upper end portion 122 of legs 118, as shown in FIG. 2.

A carrier 124 is normally disposed within the carriage 108 in vertical disposition as shown in FIG. 2 and has followers in the form of rollers 126 attached at the lower end thereof for traveling in the roller tracks 114. A one-way gate or pawl 128 is provided at the junction of the vertical leg 118 and the diagonal leg 120 so that a roller 126 may travel vertically upwardly in the vertical track leg 118 to a position above the junction with the diagonal track leg 120, and the gate 128 is biased against the wall of the vertical track leg 118 such that vertical movement downwardly of the roller 126 from the upper end portion 122 of the vertical leg 118 causes the roller 126 to ride on top of the gate 128 and into the diagonal track leg 120 to the junction thereof with the horizontal track leg 116, from whence the roller 126 is free to travel along the horizontal leg 116 to its junction with the vertical leg 118 at the lower end thereof.

A pair of synchronized chain drives 130 extend vertically at each side of the carriage 108 adjacent the portion thereof closest to the drying apparatus 30. The chain drives 130 extend between small cantilevered upper and lower sprockets 132 and 134 respectively mounted for rotation on the carrier 108, and the upper sprockets 132 are driven and synchronized by further chain drives 136 located at the outer ends of a countershaft 138 extending from side to side of the carriage 108 and driven by a third chain drive 140 from a gear motor drive 142.

Figure 13:
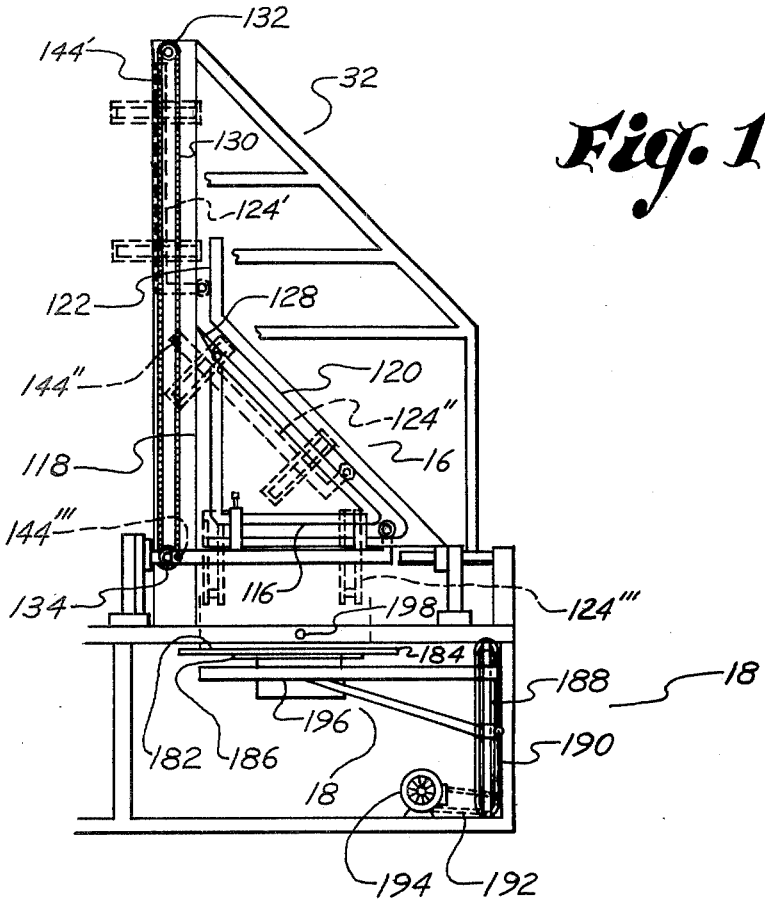
FIG. 13 is a side elevation of the carrier, carriage and receiving means components of the apparatus of FIG. 1.

The carrier 124 at the upper end thereof has pivotable connections 144 to the chain drives 130 for movement of the upper end around the complete path of the chain drives 130 on the sprockets 132 and 134. As shown in FIG. 13, clockwise rotation of the chain drives 130 carries the carrier 124 to several different positions, as indicated in broken lines and by the numerals 124', 124'', and 124''', from its normal rest position as shown in FIG. 2, and eventually returns it to that rest position. Starting from the position as shown at the numeral 124', and by the pivotable connections 144', further clockwise movement of the chain drives 130 will carry the connections 144 over the upper sprockets 132 and the carrier 124 will be carried downwardly until the roller 126 follows the vertical track leg 118 into contact with the one-way gate 128 and is thereby switched into the diagonal track leg 120 so that upon further travel of the chain drive 130, the carrier reaches the position as indicated by the numeral 124''. Continued clockwise travel of the chain drives 130 further translates and rotates the carrier 124 to a horizontal position as indicated by the numeral 124''', and this is the position at which stockings are released for stacking. Starting from the position as indicated by the numeral 144''', the pivotable connections 144 will go around the lower sprockets 134 and start to lift the carrier 124 upon continued clockwise travel of the chain drive 130. The weight of the carrier at the position 124''' will hold the rollers 126''' against the lower sides of the horizontal track legs 116 as the carrier is lifted back towards its original vertical position, so that the rollers 126 will travel horizontally to the left back to the normal rest position of the carrier 124 as shown in FIG. 2.

The locking pawls 146 form part of the upper sides of the horizontal track legs 116 and drop in behind the rollers 126 as they return to their original position as shown in FIG. 2. The limit switches 148 are actuated by the rollers 126 as the rollers approach their original positions as shown in FIG. 2, and this actuation transmits signals to the main control panel 104 for stopping the drive 142 and for moving the receiving table laterally as explained hereinafter. It is desirable to lock the rollers 126 with the pawls 146 to hold the carrier 124 in its vertical position during movement of the carriage 108 toward the drying apparatus 30.

The article engaging means 14 includes clamp means 150 mounted on the carrier 124 for movement on the carriage 108, and with the mechanical arrangement described above, the clamp means 150 is moved on the carriage 108 longitudinally of the forms 12 to remove clamped stockings and is moved by the carriage laterally to a stocking laid out position separate from the form 12 over the receiving means 18.

In movement of the carrier 124 on the carriage 108, the aforementioned tracks 114 guide the frame with the vertical legs 118 of the track forming first components parallel to the longitudinal extent of the forms for guiding movement of the carrier 124 to move the clamp means 150 longitudinally of the form for stocking removal, and the diagonal legs 120 of the tracks 114 provide second components extending from the longitudinal first components away from the form for guiding the carrier 124 to move the clamp means 150 to the laid out position above the receiving means 18. The aforementioned pivotable connections 144 serve as means for engaging the carrier 124 at a spacing from the followers or rollers 126 for moving the carrier at the engagement therewith reciprocally and parallel with the longitudinal direction of the forms while the followers and carrier at the followers follow the movement imposed by the tracks 114, with the horizontal legs 116 of the tracks providing third components connecting the first and second components of the track and the chain drives 130 providing a pair of spaced endless chains trained around the aforementioned spaced sprockets and driven in a single direction to impart generally reciprocal movement to the carrier at the engagement therewith.

Figure 10:
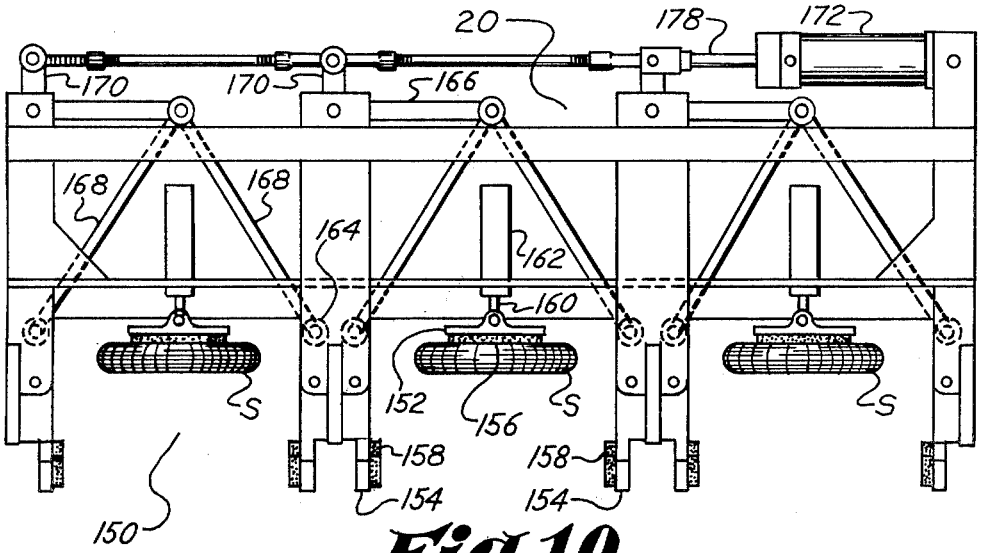
FIGS. 10, 11 and 12 are plan views of the clamp means of FIGS. 8 and 9 showing the progressive movements in clamping articles on the forms and in clamping the articles following removal from the forms.
Figure 11:
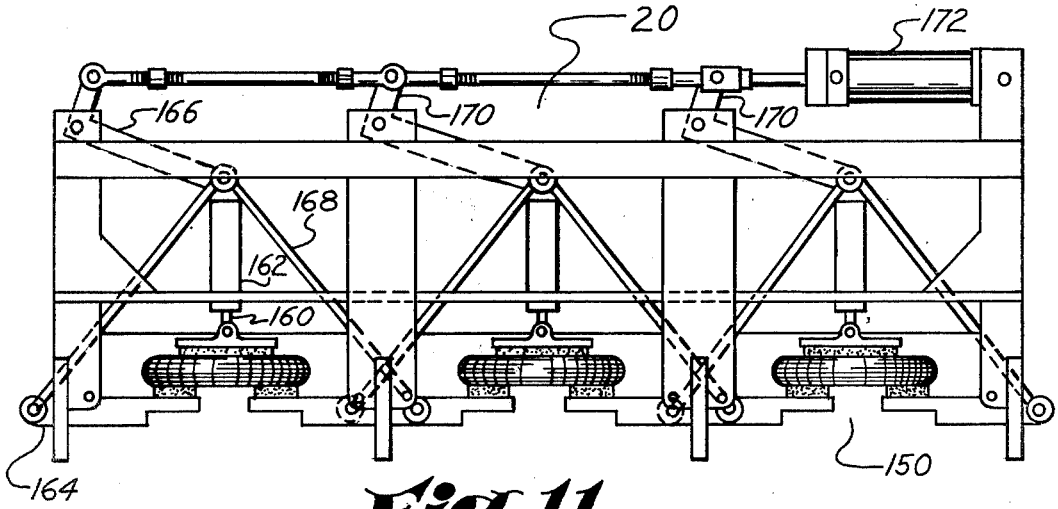
Figure 14:
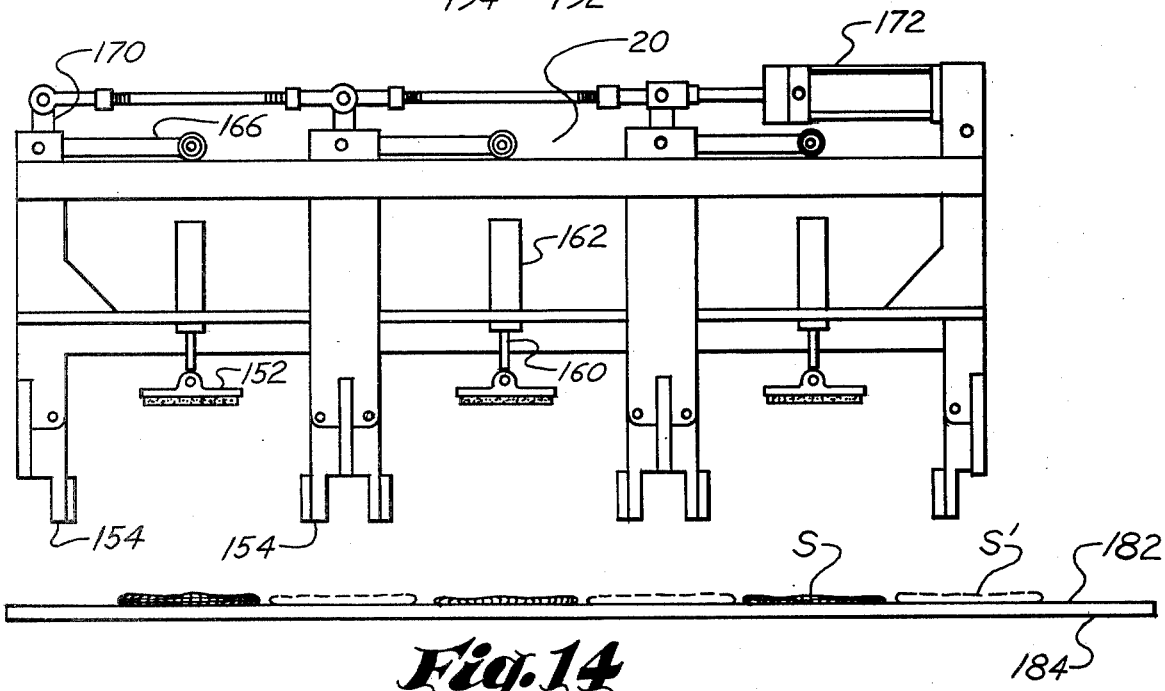
FIG. 14 is an enlarged view of the carriage, carrier, clamp means and receiving means surface of the apparatus.

There are a plurality of movable clamp means 150 mounted on the carrier 124 for engagement with, and adjacent the extreme opposite ends of, the stockings S mounted on the forms 12 presented at the removing apparatus 32. As shown in FIG. 2 the movable clamp means 150 are disposed near the toe end T and the welt end W of the stockings S, and as shown in FIG. 10 each movable clamp means 150 comprises a clamp member 152 yieldably biased in the direction of the form 12 and two movable clamp members 154 movable against a stocking and form on the opposite side thereof from the yieldably biased clamp member 152 and against which the yieldably biased clamp member clamps the stocking upon removal from the form. These movable clamp members 154 are openable to accommodate movement past the form upon lateral movement prior to clamping and have engaging or clamp surfaces 156 and 158 respectively for adherence to the stockings S when clamped thereon. The yieldable clamping members 152 are mounted pivotably at the extending ends of piston rods 160 of air cylinders 162 mounted on the carrier 124, and the piston rods are normally extended under light air pressure within the cylinders 162 but are yieldable thereagainst in a direction perpendicular to the flat sides of the forms 12 as presented to the removing apparatus 32, and parallel to the slide rods 106. The movable clamp members 154 are pivoted intermediate their lengths and adjacent the side ends of the yieldable members 152 and have actuating ends 164 opposite the ends of their engaging surfaces 158. The actuating ends 164 are connected to bell cranks 166 by links 168, and the bell cranks 166 have operating arms 170 which are linked together and to an air cylinder 172 for selective operation by the air cylinder 172 between open positions as shown in FIGS. 10 and 14 and closed or clamped positions as shown in FIGS. 11 and 12 as hereinafter explained, with the mechanism serving as a common linkage for simultaneous operation of the plurality of clamp means 150.

In the normal operation of the removing or stripping apparatus 32, the carriage 108 rests in the position as shown in FIG. 2 during indexing of the drying section 30. Upon actuation of the limit switch 102, indicating completion of an index and the beginning of a dwell period for the drying section, the resultant signal to the control panel 104 causes the cylinder 112 to move the carriage 108 toward the forms 40 until the dog 174 attached to the carriage 108 actuates the limit switch 176, thereby signaling the panel 104 to stop the motion of carriage 108, the motion having carried the yieldable clamping members 152 into contact with the stockings S mounted on the forms 40 as shown in FIG. 10. In response to actuation of the switch 176 the panel 104 is caused to retract the piston rod 178 of the air cylinder 172, thereby moving the clamp surfaces 158 of the movable clamp members 154 into engagement with the stockings S on the forms 40 in opposition to the yieldable members 152 and generally parallel to the clamp surfaces 156 thereof, which clamp surfaces 156 and 158 are normally covered with a resilient, adherent material.

Simultaneously with the closing of the clamp members 154, the gear motor 142 starts, thereby causing the carrier 124 to rise vertically and simultaneously removing the three clamped stockings S from the forms 40 to a position vertically above the forms 40 where the stockings S are held engaged by the clamp members 154 and 156 in essentially the same configuration and relation that they had on the forms 40.

Figure 12:
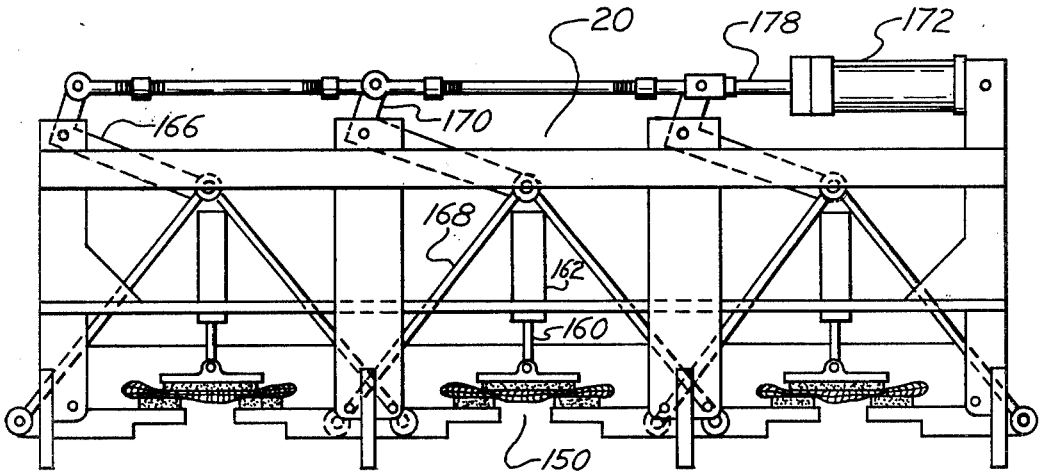

Arrival of the carrier 124 near the uppermost limit of its vertical travel actuates a limit switch 179 which signals the panel 104 to move the carriage 108 back to its original position as shown in FIG. 2, thereby withdrawing the stockings S, now held as shown in FIG. 12, from their positions directly over the forms 40 so that continuing movement of the chain drives 130 may move the carrier 124 unobstructed from its position as shown by the numeral 124' in FIG. 13 to its successive positions as indicated by the numerals 124" and 124'''.

Arrival of the carrier 124 at the releasing position 124''' actuates a limit switch 180, thereby extending the piston rod 178 of the air cylinder 172 to open the movable clamp members 154, releasing the stockings S in their flat, laid out, configuration, just as they came from the forms 40, onto a receiving table. The chain drives 130 continue their movement, carrying the pivotable connections 144 around the lower sprockets 134 and then vertically upwardly to return the carrier 124 to its original position as shown in FIG. 2, at which the micro switches 148 signal the panel 104 to stop the drive 142, and a stocking removal, transport, and release cycle is complete.

The article receiving means 18, as shown in FIGS. 1, 2 and 13, is disposed directly beneath the position of the carrier 124 as indicated by the numeral 124''' in FIG. 13 and presents a horizontal upper surface 182 for reception of stockings S thereon. The surface 182 may be that of a square plywood board 184 which is removably connected to a table 186. The article receiving means 18 is slidably mounted from two vertical slide rods 188 mounted on the frame 34 at opposite sides thereof at the end portion thereof farthest from the drying section 30, as shown in FIG. 13. A chain drive 190 driven by another chain drive 192 from a gearmotor 194 is connected to a slide structure 196 of the receiving means 18 and is selectively operable to move the receiving means 18 downwardly in response to stockings S blocking the light beam of a photocell unit 198 trained just above the uppermost desired position of the receiving means 18. The photocell unit 198 is connected to the control panel 104 to control the gearmotor 194, and a first counting relay in panel 104 is actuated at each stacking cycle and acts to stop the stacking cycles and return the receiving means 18 to its uppermost position after a selectively predetermined number of layers of stockings have been laid out on the surface 182. This arrangement provides means for incrementally lowering the article receiving means 18 to receive subsequent layers of articles at generally the same level as that at which the initial layer is received.

Figure 15:
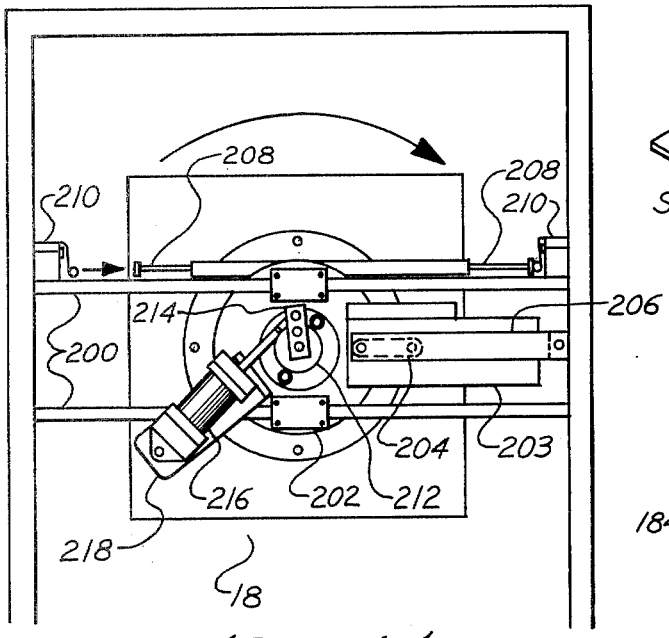
FIGS. 15 and 16 are enlarged bottom views of the means for moving the receiving means to form stacks of crosswise layers of articles.
Figure 16:
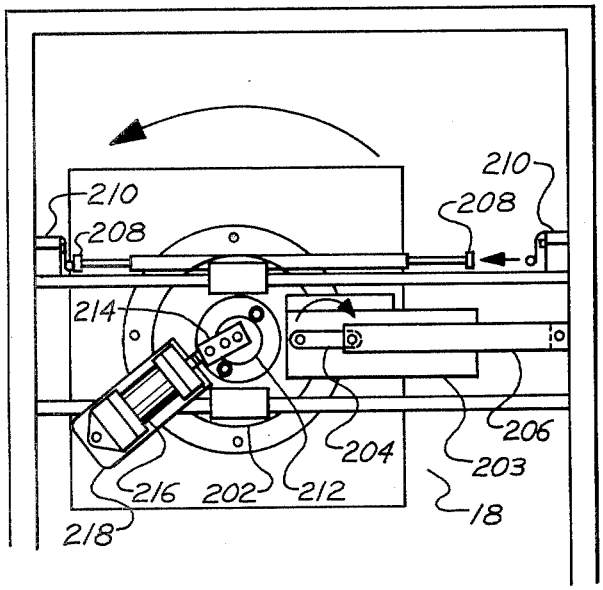

As shown in FIGS. 15 and 16, a second pair of horizontal slide rods 200 is mounted on the slide structure 196 and the table 186 is slidably mounted thereon for motion laterally relative to stockings S being held by the carrier 124 for release thereon to provide means for moving the article receiving means 18 between a plurality of linearly spaced positions that are spaced apart a distance at least equivalent to the extent of the stockings in the direction of movement to receive stockings in adjacent parallel disposition to form a layer. A gearmotor 203 mounted from the supporting structure 202 for the table 186 rotates a crank arm 204 mounted on the shaft thereof. The extending end of the crank arm 204 is pivotably connected to a drag link 206 at one end thereof, and the other end thereof is pivotably connected to the frame 34 so that rotation of the crank arm 204 causes the table 186 to reciprocate on the slide rods 200. Adjustable stops 208 mounted on the structure 202 engage limit switches 210 at the limits of the reciprocation and stop the gearmotor 203 at each limit, while one of the switches 148 described hereinbefore gives a signal at the end of each stacking cycle to the panel 104 to start the gearmotor 203 to make a half revolution of the crank arm 204.

As also shown in FIGS. 15 and 16, the table 186 is mounted on a vertical shaft 212 which is journaled in the supporting structure 202 for rotation therein, and a lever arm 214 is attached to the lower end of shaft 212 for oscillation by an air cylinder 216 which has its piston rod pivotably connected to the extending end of the lever 214. The cylinder 216 is pivotably connected at the blind end thereof to a bracket 218 attached to the supporting structure 202. A second counting relay in the control panel 104 receives an impulse at each stacking cycle and after a selectively predetermined number of stacking cycles signals the panel 104 to cause the cylinder 216 to reverse its condition, whether piston extended or retracted, thereby causing the table 186 to oscillate horizontally through 90°. This arrangement provides means for rotating the receiving means 18 between a plurality of article receiving positions to receive articles in crosswise stacked disposition.

Figure 17:
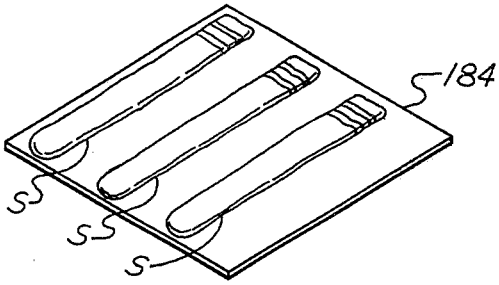
FIGS. 17, 18, 19 and 20 are diagrammatic illustrations of the progressive receipt of articles on the receiving means and movements of the receiving means in forming stacks of crosswise layers of articles.
Figure 18:
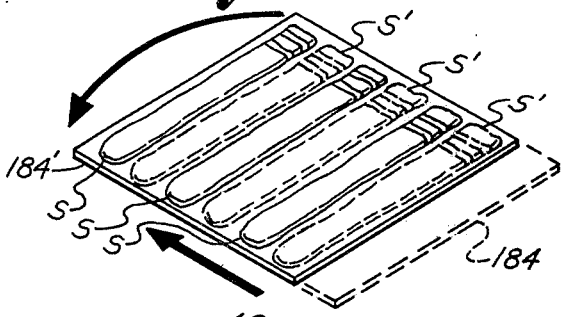
Figure 19:
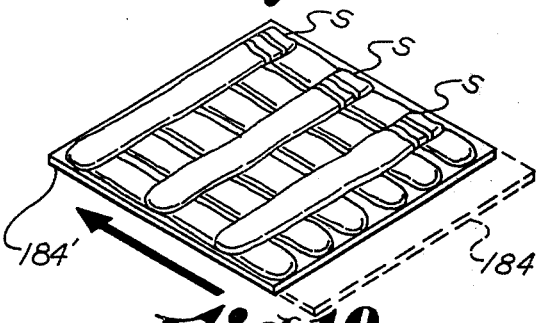
Figure 20:
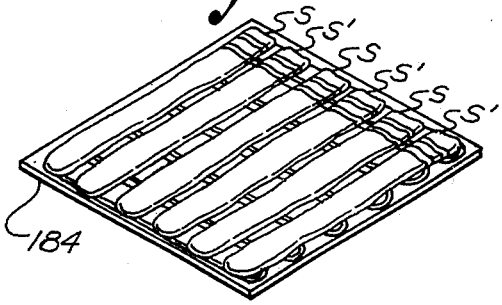

In the cyclic operation of the receiving means 181, the carrier 124 arriving at its position 124''' actuates the switch 180 to release the stockings S being transported, and effectively pauses there briefly while the pivotable connections 144 travel around the sprockets 134. The stockings S are released and laid out on the receiving means 18 in essentially the same flat configuration and spaced apart relation which they had upon the forms 12, with spaces between the stockings S for another set of stockings as shown in FIG. 17. As the carrier 124 returns to its original position as in FIG. 2, the switches 148 are actuated, one of them signalling the panel 104 to start the gearmotor 203 to shift the board 184 laterally with respect to the stockings S just laid out thereon from the broken line position 184 in FIG. 18 to the solid line position 184'. At the same time the limit switch 220 is actuated by the near side roller 126 and signals a timer in the panel 104 to start another cycle of index-remove-transport-release, so that the next set of stockings S released onto the board 184 will be laid out at the broken line positions designated S' in FIG. 18, between and beside those shown in solid lines and designated S. In the preferred embodiment, the board 184 is shifted thus at each cyle, and at every fourth cycle the cylinder 216 is actuated to rotate the board 184 by 90° so that at the fifth through the eighth cycles the stockings are laid out cross-wise of those laid out at the first through fourth cycles, stacking at the fifth and seventh cycles the stockings designated S in FIGS. 19 and 20, and at the sixth and eighth cycles those designated S' in FIG. 20. The side-by-side and cross-laying sequence continues until a predetermined number of layers has been stacked, the receiving means 18 being lowered incrementally in response to signals from the photocell unit 190; and the apparatus is halted by a signal from the first counting relay for manual removal of the board 184 with the stockings S thereon, manual substitution of an empty board 184 on the table 186, and a manual restarting of the cycle.

The control panel 104 is suitably equipped with manual switches such that the operating elements may be manually cycled, and also such that a single index-remove-transport-release cycle may be initiated by pressing the footswitch 98 and the entire apparatus will halt at the end of the cycle. It will be noted that the movable means 150 for engaging the stockings S on the forms 12 are conformant with minor positional variations of forms 12 and with changes in the intrinsic thickness of the stockings S, as well as with the changes in thickness dimensions of the clamped stockings S as they are removed from the forms 12. As shown in FIGS. 10–12, the yieldable clamp members 152 pivot on their supporting piston rods 160 and yield freely with the piston rods to accommodate themselves to the forms 12 and the stockings S; and as the stockings are removed from the forms by the movable means 150, the yieldable members 152 are extended on their piston rods 160 to take up the thickness formerly occupied by the forms 40.

To effect stacking in the manner described above, the forms 12 are mounted on the base 22 in sets with a plurality of forms 12 in each set, the illustrated embodiment having three forms in each set. The forms in each set are generally coplanar and are disposed at lateral spacings generally equivalent to a multiple of the laid out lateral extent of the articles, in the illustrated embodiment the multiple is two, so that there is an open space between adjacent forms equivalent to the lateral extent of the stockings. In this manner the stockings are received on the receiving means 18 in the same spaced condition, and the means for moving the article receiving means laterally moves it between a plurality of article receiving positions corresponding in number to the multiple, in this case two, and at spacings equivalent to the laid out lateral extent of an article for sequential receipt of a plurality of sets of parallel articles to form a layer of articles on the receiving means 18.

With the apparatus described hereinabove, the entire operation, except for feeding and removal, is accomplished automatically and only a single operator is required to place stockings on the forms 12 as they are indexed through a loading position. The stockings advance on the forms automatically for drying on the forms 12 and presentment in sets of three at the removal section 32, at which the stockings are removed from the forms and stacked on the board 184, all automatically, requiring operator attention only to remove a filled board and replace an empty board when a complete stack has been formed.

The particular embodiment disclosed in full detail herein and illustrated in the drawings has been provided for disclosure purposes only and is not intended to limit the scope of the present invention, which is to be determined by the scope of the claims.

I claim:

1. Apparatus for removing flaccid articles, for example stockings having toe and welt ends, from forms and stacking the articles in laid out condition comprising:

(a) movable means for engaging an article on a form adjacent extreme opposite ends of said article as at said toe and welt ends of a stocking;

(b) article receiving means;

(c) means for moving said article engaging means from said form to remove said article from said form and move it from said form while holding it in essentially the same configuration it had on said form to a position separate from said form over said receiving means in generally horizontally laid out disposition; and (d) means for operating said article engaging means for said engaging said article on said form adjacent said extreme opposite ends of said article, to maintain said engaging during said removing, moving, and holding, and to release said article onto said receiving means in said laid out condition whereby said stacking is controlled and accurate.

2. Apparatus for removing flaccid articles from forms and stacking the articles in laid out condition according to claim 1 and characterized further in that said article engaging means includes clamp means positionable adjacent opposite ends of an article on the form and engageable to clamp said article on the form, said moving means moving said clamp means longitudinally of said form to slide said clamp means and clamped article from said form.

3. Apparatus for removing flaccid articles from forms and stacking the articles in laid out condition according to claim 2 and characterized further in that said moving means moves said article engaging means laterally of said form to position said clamp means for article engagement at said form.

4. Apparatus for removing flaccid articles from forms and stacking the articles in laid out condition according to claim 3 and characterized further in that each said clamp means includes a clamp member yieldably biased in the direction of the form for yieldable engagement with the article and form upon said lateral movement of said article engaging means, and a clamp member movable against the article and form on the opposite side thereof from said yieldably biased clamp member and against which said yieldably biased clamp member clamps the article upon removal from the form.

5. Apparatus for removing flaccid articles from forms and stacking the articles in laid out condition according to claim 4 and characterized further in that said movable clamp member is operable to accommodate movement past the form upon said lateral movement prior to clamping.

6. Apparatus for removing flaccid articles from forms and stacking the articles in laid out condition according to claim 3 and characterized further in that each said clamp means includes a clamp member yieldably biased in the direction of the form and movable thereagainst upon said lateral movement of said article engaging means for yieldable engagement with the article and form, and a pair of openable clamp members movable against the article and form on the opposite side thereof from said yieldably biased clamp member and against which said yieldably biased clamp member clamps the article upon removal from the form, said openable clamp members being openable to accommodate movement past the form upon said lateral movement prior to clamping.

7. Apparatus for removing flaccid articles from forms and stacking the articles in laid out condition according to claim 3 and characterized further in that said means for moving said article engaging means includes a carriage on which said clamp means are carried and which is movable laterally of the forms to position said clamp means for clamping, said moving means moving said clamp means on said carriage longitudinally of said forms to remove clamped articles from the forms and to an article laid out position, said carriage being movable laterally to position said clamp means in article laid out position over said receiving means.

8. Apparatus for removing flaccid articles from forms and stacking the articles in laid out condition according to claim 7 and characterized further in that said means for moving said article engaging means includes a carrier movably carried on said carriage and on which said clamp means are mounted for movement therewith with respect to said carriage longitudinally of the form and to said laid out position, said carrier and clamp means being movable laterally with said carriage.

9. Apparatus for removing flaccid articles from forms and stacking the articles in laid out condition according to claim 8 and characterized further in that said carriage has mounted thereon a pair of spaced tracks in which said carrier is engaged for guiding movement of said carrier on said carriage, said tracks having first components parallel to the longitudinal extent of said form for guiding movement of said carrier to move said clamp means longitudinally of said form to remove an article from the form, said tracks having second components extending from said first components away from said form for guiding said carrier to move said clamp means to article laid out position.

10. Apparatus for removing flaccid articles from forms and stacking the articles in laid out condition according to claim 9 and characterized further in that said carrier has a track follower engaged in each track, and said means for moving said article engaging means includes means engaging said carrier at a spacing from said followers for moving said carrier at the engagement therewith reciprocally and parallel with the longitudinal direction of the forms while the followers and carrier at the followers follow the tracks.

11. Apparatus for removing flaccid articles from forms and stacking the articles in laid out condition according to claim 10 and characterized further in that said tracks have third components connecting said first and second components, and said means engaging said carrier includes a pair of spaced endless chains each trained around a pair of spaced sprockets that are driven in a single direction to impart generally reciprocal movement to said carrier at the engagement therewith.

12. Apparatus for removing flaccid articles from forms and stacking the articles in laid out condition according to claim 1 and characterized further by means for moving said article receiving means between a plurality of article receiving positions including an initial position and a position spaced linearly from said initial position a distance at least equivalent to the extent of the article in the direction of movement to receive articles in adjacent parallel disposition to form a layer of articles on said receiving means.

13. Apparatus for removing flaccid articles from forms and stacking the articles in laid out condition according to claim 1 and characterized further by means for rotating said article receiving means between a plurality of article receiving positions to receive articles in crosswise stacked disposition.

14. Apparatus for removing flaccid articles from forms and stacking the articles in laid out condition according to claim 13 and characterized further by means for moving said article receiving means between a plurality of linearly spaced positions that are spaced apart a distance at least equivalent to the extent of the article in the direction of movement to receive articles in adjacent parallel disposition to form a layer of articles on said receiving means, and said rotating of said receiving means causing layers to be received in crosswise stacked disposition.

15. Apparatus for removing flaccid articles from forms and stacking the articles in laid out condition according to claim 14 and characterized further by means for incrementally lowering said article receiving means to receive subsequent layers of articles at generally the same level as that at which the initial layer is received.

16. Apparatus for removing flaccid articles from forms and stacking the articles in laid out condition according to claim 1 and characterized further by a plurality of forms disposed in longitudinally parallel relation, and said article engaging means includes a plurality of clamp means for simultaneously engaging articles on a plurality of forms for removing, positioning and releasing the articles in sets.

17. Apparatus for removing flaccid articles from forms and stacking the articles in laid out condition according to claim 16 and characterized further in that said operating means includes a common linkage for simultaneous operation of said plurality of clamp means.

18. Apparatus for removing flaccid articles from forms and stacking the articles in laid out condition according to claim 16 and characterized further in that said plurality of forms are disposed generally coplanar at lateral spacings generally equivalent to a multiple of the layed out lateral extent of an article, and by means for moving said article receiving means laterally between a plurality of article receiving positions corresponding in number to said multiple and at spacings equivalent to the layed out lateral extent of an article for sequential receipt of a plurality of sets of parallel articles to form a layer of articles on said receiving means.

19. Apparatus for removing flaccid articles from forms and stacking the articles in laid out condition according to claim 18 and characterized further by means for rotating said article receiving means between positions disposing adjacent layers of articles in crosswise stacked disposition.

20. Apparatus for removing flaccid articles from forms and stacking the articles in laid out condition according to claim 19 and characterized further by means for incrementally lowering said article receiving means to receive subsequent layers of articles at generally the same level as that at which the initial layer is received.

21. Apparatus for removing flaccid articles from forms and stacking the articles in laid out condition according to claim 1 and characterized further by a plurality of forms mounted in sets on a base with the forms in each set being in longitudinally parallel relation, said base being indexable to position the sets of forms sequentially for removal of articles therefrom, and said article engaging means includes a plurality of clamp means for simultaneously engaging articles on the forms of a set for removing, positioning and releasing the articles in sets.

22. Apparatus for removing flaccid articles from forms and stacking the articles in laid out condition according to claim 21 and characterized further in that said forms in each set are disposed generally coplanar, said sets are disposed circumferentially on said base, and said base is rotatably indexed.

23. Apparatus for removing flaccid articles from forms and stacking the articles in laid out condition according to claim 22 and characterized further by means for interiorly heating said forms for boarding of articles thereon prior to positioning of said forms for removal by said clamp means.

* * * * *